US006017250A

United States Patent [19]

Tsuji et al.

[11] Patent Number: 6,017,250

[45] **Date of Patent: *Jan. 25, 2000**

[54] CONNECTOR

[75] Inventors: Masanori Tsuji; Osamu Sugiyama; Norio Matsumura, all of Shizuoka-ken, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/887,266

[22] Filed: Jul. 2, 1997

[30] Foreign Application Priority Data

Jul. 4, 1996 [JP] Japan ..... P 8-175161

[51] Int. Cl.[7] ..... H01R 13/502

[52] U.S. Cl. ..... 439/701

[58] Field of Search ..... 439/597–601, 439/677, 680, 686, 695, 701, 328, 924

[56] References Cited

U.S. PATENT DOCUMENTS

| | | | |
|---|---|---|---|
| 4,923,411 | 5/1990 | Hayashi et al. | 439/540 |
| 5,154,630 | 10/1992 | Kamono et al. | 439/701 X |
| 5,190,476 | 3/1993 | Chaillot | 439/680 X |
| 5,240,433 | 8/1993 | Kato | 439/587 |
| 5,312,268 | 5/1994 | Sumida | 439/364 |
| 5,344,347 | 9/1994 | Inoue et al. | 439/701 |
| 5,564,953 | 10/1996 | Endo et al. | 439/903 X |
| 5,573,430 | 11/1996 | Hatagishi | 439/701 |

FOREIGN PATENT DOCUMENTS

| | | |
|---|---|---|
| 1515377 | 2/1962 | Germany . |
| 6-119955 | 4/1994 | Japan . |
| 8-64295 | 3/1996 | Japan . |

*Primary Examiner*—Khiem Nguyen
*Attorney, Agent, or Firm*—Finnegan, Henderson, Farabow, Garrett & Dunner, L.L.P.

[57] ABSTRACT

A male sub-connector has a plurality of terminal accommodating chambers for accommodating female terminal metal members respectively. A holding member accommodates a plurality of male sub-connectors. A plurality of terminal receiving portions are provided on a cover wall of the holding member. Entrance portions of the male sub-connector open to the terminal receiving portions to receive male terminal metal members of a female sub-connector. At the time of engaging the holding member with the female sub-connector, the engagement is influenced by only a deviation between the holding member and the male sub-connector, there arises only a small positional deviation, so that the male terminal metal members of the female sub-connector can be entered securely into the terminal accommodation chambers without being interrupted.

5 Claims, 3 Drawing Sheets

CONNECTOR

BACKGROUND OF THE INVENTION

1. Field of the Invention

The present invention relates to a connector to be used for mutually connecting electrical parts mounted on an automobile or the like.

2. Description of the Related Art

In an automobile, the operation of many parts of the car, such as the operation of lamps, a car audio equipment, an angular adjustment and forward and backward positional adjustment of a reclining seat, automatic locking of doors, etc. is carried out by power supply from a battery. A connector is used for carrying out a power distribution to these parts, and a technology for a batch line connection is being developed in order to efficiently achieve these multipolar connections. A batch connection is for connecting a plurality of sub-connectors, such as male sub-connectors, for example, with the other sub-connectors, such as a female sub-connector, by holding the male sub-connectors in a holding member.

A plurality of terminal accommodation chambers are formed in each of the male sub-connectors and a plurality of female terminal metal members are provided in each of the plurality of terminal accommodation chambers. Further, in the female sub-connector, a plurality of male terminal metal members are provided to engage with the plurality of female terminal metal members.

A cover wall is provided at the side of the terminal accommodation chambers of the male sub-connectors which are engaged with the female sub-connector. The cover wall is provided with a plurality of terminal receiving portions having through-holes through which the male terminal metal members of the female sub-connectors are connected with the female terminal metal members of the male sub-connector. In the through-holes, a plurality of terminal guiding surfaces are formed so that the male terminal metal members can be easily engaged with the female terminal metal members through the through-holes of the cover wall.

In the above-described structure, at first the male sub-connectors are engaged with the holding member, and then the holding member is engaged with the female sub-connector for engaging the male sub-connectors with the female sub-connector, and then the female terminal metal members are connected with the male terminal metal members.

According to the above-described structure, however, not only an engagement clearance between the male sub-connectors and the holding member exists but also an engagement clearance between the holding member and the female sub-connector exists. Accordingly, at the time of piercing the male terminal metal members through the through-holes, the piercing operation is influenced by the two clearances, with a result that there arises a positional deviation between the positions of the front ends of the male terminal metal members and the positions of the terminal receiving portions formed in the through-holes.

When the holding member is combined with the female sub-connector in this state, the male terminal metal members are not engaged with the terminal receiving portions but the male terminal metal members are struck against the cover wall of the male sub-connectors, with a result that the male terminal metal members are deformed by this strike. Therefore, the male terminal metal members can not enter the terminal accommodation chambers, which causes a conduction failure.

SUMMARY OF THE INVENTION

The present invention is conceived to solve the above-described problem. It is an object of the present invention to provide a connector which ensures a smooth and secure entering of a male terminal metal members of a female sub-connector into a terminal accommodation chambers of a male sub-connectors for engaging the male terminal metal members of the female sub-connector with the female terminal metal members so that a deformation of the male terminal metal members can be prevented and an electrical current can be conducted securely.

In order to achieve the above-described object, according to a first aspect of the present invention, there is provided a connector, comprising: a first sub-connector having a terminal accommodation chamber for accommodating a first terminal member; a second sub-connector for accommodating a second terminal member which is connected with the first terminal member; and a holding member for holding the first sub-connector, the holding member being engagement with the second sub-connector so that the first sub-connector is engaged with the second sub-connector, wherein the holding member includes a cover wall at a side engaged with the second sub-connector, the cover wall is formed with a terminal receiving portion having a through-hole for being pierced by the second terminal member of the second sub-connector to be connected with the first terminal member.

According to a second aspect of the invention, as it depends from the first aspect, the holding member has an insertion opening for receiving the first sub-connector to be inserted at a side opposite to the cover wall.

In the above construction, by inserting the first sub-connector into the insertion opening of the holding member, the first sub-connector is fitted to the holding member by keeping contact with the cover wall.

According to a third aspect of the invention, as it depends from the second aspect, the first sub-connector is formed with an entrance portion at a side of the cover wall, the entrance portion opens to the terminal receiving portion having the through-hole during the first sub-connector is held by the holding member.

In the above construction, since the entrance portion of the terminal accommodation chamber of the first sub-connector is opened to the terminal receiving portion formed on the cover wall, the second terminal metal member of the second sub-connector is able to pierce easily the terminal receiving portion into the terminal accommodation chamber. With this structure, the second terminal metal member can enter securely the terminal accommodation chamber.

According to a fourth aspect of the invention, as it depends from the third aspect, the terminal receiving portion is formed with a terminal guiding surface slanted for guiding the second terminal member into the through-hole to be connected with the first terminal member.

In the above construction, the terminal receiving portion having a through-hole which is pierced by the second terminal member inserted into the terminal accommodation chambers of the first sub-connector is formed with the terminal guiding surface. Accordingly, there is only one loose gap between the holding member and the second sub-connector with a minimum positional deviation. Therefore, the second terminal metal members of the second sub-connector can enter the terminal accommodation chambers smoothly without being interrupted by the holding member. Thus, there arises no deformation of the second terminal metal members and an electrical current is conducted securely.

Since the second terminal member can be guided to the terminal accommodation chamber, it is not necessary to form the terminal guiding surface at the terminal accommodation chamber, that results in a simple structure of the first sub-connector.

According to a fifth aspect of the invention, as it depends from the fourth aspect, a plurality of the terminal accommodation chambers are provided in the first sub-connector and a plurality of the first terminal members are provided in the plurality of the terminal accommodation chambers to be connected to a plurality of the second terminal members provided in the second sub-connector through a plurality of the through-holes formed on the cover wall respectively.

In the above construction, since the entrance portions of the terminal accommodation chambers of the first sub-connectors are opened to the terminal receiving portions formed on the cover wall, the terminal guiding surfaces of the terminal receiving portions guide the second terminal metal members of the second sub-connector into the terminal accommodation chambers. With this structure, the second terminal metal members can enter securely the terminal accommodation chambers. Thus, there arises no deformation of the second terminal metal members and an electrical current is conducted securely.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 1 is a perspective view for showing the state before assembling the holding member and the male sub-connectors according to an embodiment of the present invention;

FIG. 2 is a cross-sectional view for showing the state before assembling the holding member and the male sub-connectors according to the embodiment of the present invention; and FIG. 3 is a cross-sectional view for showing the state of assembling the holding member and the male sub-connectors and a cross-sectional view of the female sub-connector according to the embodiment of the present invention.

DETAILED DESCRIPTION OF THE PREFERRED EMBODIMENTS

Figure 1:
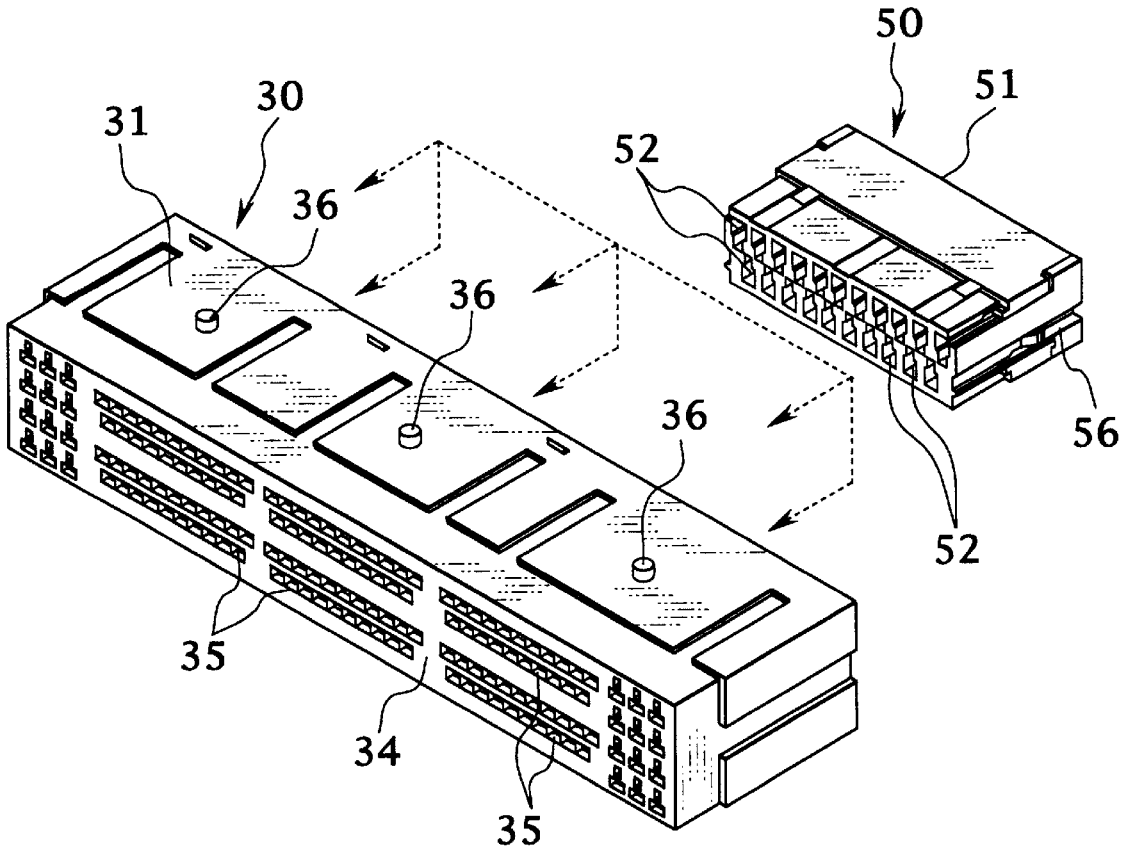

There will be detailed below the preferred embodiments of the present invention with reference to the accompanying drawings. Like members are designated by like reference characters.

Referring to FIG. 1, one embodiment of the present invention will be described hereinafter. A connector of the present embodiment has a holding member 30 and a plurality of male sub-connectors 50 as a first sub-connectors mounted on the holding member 30.

Each of the male sub-connectors 50 has a housing 51 formed by an insulating resin in a rectangular shape and a plurality of terminal accommodation chambers 52 formed in the housing 51. Although more than one terminal accommodation chambers 52 are disposed in one lateral row and two vertical stages with respect to the housing 51 are provided according to this embodiment, the form of disposition is not limited to this so long as a plurality of terminal accommodation chambers are provided. Each terminal accommodation chamber 52 is isolated from adjacent terminal accommodation chambers 52 by being separated by a partition wall. A female terminal metal member 53 as a first terminal member is accommodated within each partitioned terminal accommodation chamber 52.

Figure 2:
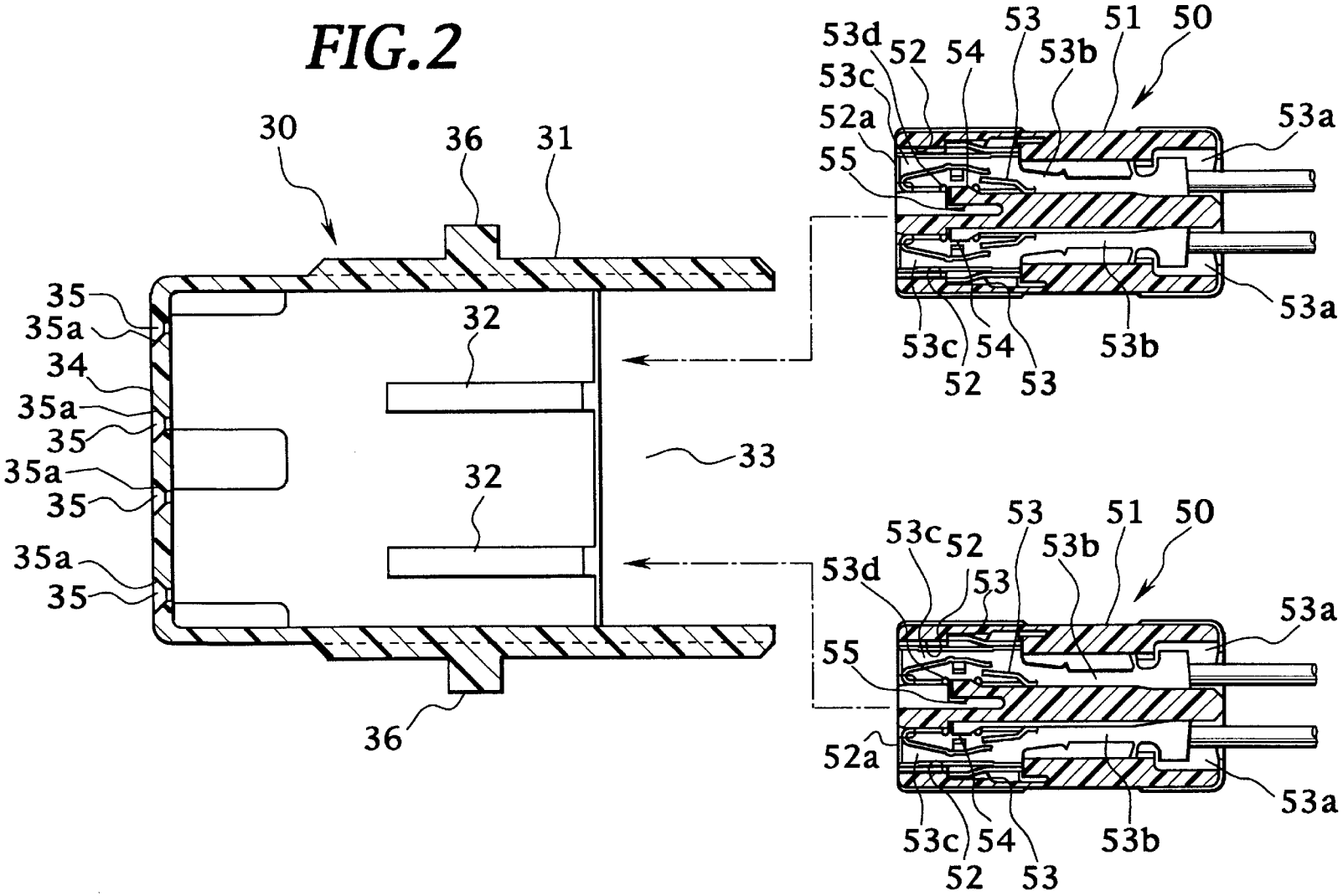

Each female terminal metal member 53 is connected by an electric wire (not shown) and is inserted by a male terminal metal member 11 as a second terminal member of a female sub-connector 10 as a second sub-connector. When the male terminal metal member 11 is engaged with the female terminal metal member 53 in a contact state, the electric wire is electrically connected with the female sub-connector 10. Accordingly, as shown in FIG. 2, the female terminal metal member 53 is structured with an electric wire caulking portion 53*a* by which the electric wire is fastened, a connection portion 53*c* into which the male terminal metal member 11 is inserted, and a conductor caulking portion 53*b* positioned between the electric wire caulking portion 53*a* and the connection portion 53*c*, for caulking or fastening the conductor exposed from the electric wire.

Each female terminal member 53 is inserted into each terminal accommodation chamber 52 so that the female terminal member 53 is engaged with the housing 51. The female terminal member 53 is fixed within the terminal accommodation chamber 52 in a fastened state by this engagement. In order to achieve this engagement, an engagement projection 54 is provided within each terminal accommodation chamber 52. The engagement projection 54 is stretched within the terminal accommodation chamber 52 in an elastic state by having a recess portion 55 formed by cutting a portion of the housing 51 in each terminal accommodation chamber 52. On the other hand, an engagement hole 53*d* for having an engagement with the engagement projection 54 is formed on the female terminal metal member 53. By pressuring the female terminal metal member 53 into the terminal accommodation chamber 52, these members are mutually engaged to have a fastened state.

Guide slits 56 are formed on left and right outer ends of the housing 51 of the male sub-connector 50, as shown in FIG. 1. The guide slits 56 work as a guide for inserting the male sub-connector 50 into the holding member 30. Guide projections 32 for sliding the guide slits 56 are formed inside the holding member 30, as shown in FIG. 2.

The male sub-connectors 50 having the above-described structure are mounted on the holding member 30 as described later. By building the holding members 30 into the female sub-connector 10 in this mounted state, each male terminal metal member 11 of the female sub-connector 10 is inserted into each terminal accommodation chamber 52. This insertion is carried out from the front end side (left end side) of the connection portion 53*c* of the female terminal metal member 53. An entrance portion 52*a* of the terminal accommodation chamber 52 in which the front end side of the connection portion 53*c* is positioned is in an open state without being shut partially. In other words, the entrance portion 52*a* for this purpose is opened by having a diameter which is the same as the diameter of the terminal accommodation chamber 52. By having the entrance opening portion 52*a* in an opened state in this way, the male terminal metal member 11 of the female sub-connector 10 can enter smoothly each terminal accommodation chamber 52 without being interrupted by the front end surface of the housing 51.

Figure 3:
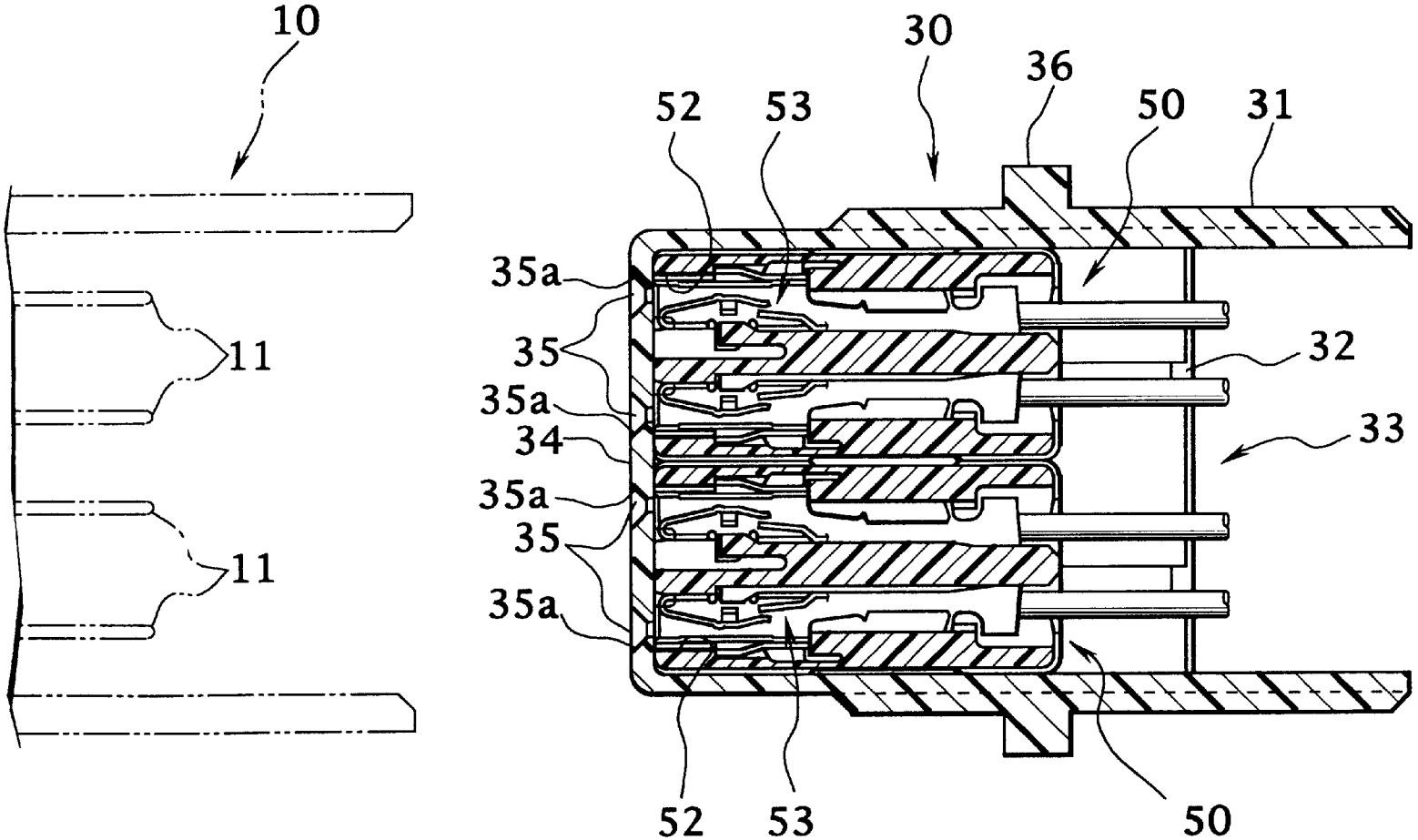

The holding member 30 having the male sub-connectors 50 mounted thereon in the manner as described above has a main body 31 of a laterally long rectangular shape formed by an insulating resin. This main body 31 is formed in a "]" shaped cross section as shown in FIG. 2 and FIG. 3, and an insertion opening 33 for inserting a plurality of male sub-connectors 50 thereinto is formed on the rear side of the opening. The above-described guide projections 32 are provided at the portion of the insertion opening 33.

The front end side which is opposite to the insertion hole 33 formed on the main body 31 is a cover wall 34 almost the whole portion of which is covered. The front ends of the male sub-connectors 50 which are inserted into the main body 31 from the insertion opening 33 are brought into contact with this cover wall 34 and the insertion operation is stopped to thereby carry out the mounting operation.

A plurality of terminal receiving portions 35 having through-holes are provided on the cover wall 34. As shown in FIG. 2 and FIG. 3, the each terminal receiving portion 35 is formed with each terminal guiding surface 35*a* slanted and tapered in such a manner that the terminal receiving portion 35 is wider at the side of the female sub-connector 10 than at the side of the male sub-connector 50. Each terminal receiving portions 35 is formed with four terminal guiding surfaces 35*a* in the embodiment as shown in FIG. 1. The terminal guiding surfaces 35*a* are able to be modified as a conical surface in another embodiment, namely one terminal receiving portion is formed with one conical terminal guiding surface.

The terminal receiving portions 35 are formed on the cover wall 34 at the positions corresponding to the terminal accommodation chambers 52 of the male sub-connectors 50 to be mounted on the main body 31 with the same number as the number of the terminal accommodation chambers 52. According to this embodiment, since the male sub-connectors 50 are mounted in three lateral rows and two vertical stages, the terminal receiving portions 35 are formed in a group to have three lateral rows and two vertical stages corresponding to the layout of the terminal accommodation chambers 52 of each male sub-connector 50, as shown in FIG. 1.

When each terminal receiving portion 35 is corresponded to each terminal accommodation chamber 52 of each male sub-connector 50 in this way, each terminal receiving portion 35 is connected to each terminal accommodation chamber 52. By this connection, each terminal receiving portion 35 guides each male terminal metal member 11 (reference FIG. 3) of each female sub-connector 10 into each terminal accommodation chamber 52 of each male sub-connector 50 inside the main body 31. By the guide of each terminal receiving portion 35, each male terminal metal member 11 is brought into contact with each female terminal metal member 53 within each terminal accommodation chamber 52.

On the upper and lower surfaces of the main body 31 of the holding member 30, short stopping projections 36 are formed with a suitable distance between the adjacent stopping projections 36 so that these stopping projections 36 are engaged with stopping grooves (not shown) formed on the female sub-connector 10. With this arrangement, the holding member 30 is fitted to the female sub-connector 10 at a fixed position without generating an inclination.

FIG. 3 shows a state that the male sub-connectors 50 are mounted within the main body 31 of the holding member 30 in two vertical stages. The male connectors 50 are inserted into the main body 31 from the insertion opening 33 with the guide projections 32 used as the guide, and the front end surfaces of the male connectors 50 are brought into contact with cover wall 34 so that the insertion operation is stopped. Thus, the terminal receiving portions 35 are connected with the terminal accommodation chambers 52 of the male sub-connectors 50.

When the holding member 30 is engaged with the female sub-connector 10 in the state that the male sub-connectors 50 are mounted within the main body 31, since the terminal receiving portions 35 provided in the holding member 30 are connected with the terminal accommodation chambers 52 of the male sub-connectors 50 and, at the same time, the terminal receiving portions 35 are formed on the cover wall 34 facing the male terminal metal members 11, a loose gap is generated only between the male terminal metal members 11 of the female sub-connector 10 and the holding member 30, so that there arises only a small positional deviation between the holding member 30 and the female sub-connector 10.

Further, since the terminal receiving portions 35 face the female sub-connector 10 and the terminal receiving portions 35 smoothly guide the male terminal metal members 11, the male terminal metal members 11 are not bumped against the cover wall 34 of the holding member 30 so that a deformation of the male terminal metal members 11 can be prevented. Moreover, since the male terminal metal members 11 are smoothly guided into the terminal accommodation chambers 52 by the terminal receiving portions 35, the male terminal metal members 11 can be connected with the female terminal metal members 53 within the terminal accommodation chambers 52, which ensures a secure electrical connection.

In the above-described embodiment, although the male terminal metal members 11 of the female sub-connector 10 are guided into the terminal accommodation chambers 52 of the male sub-connectors 50 by having the terminal receiving portions 35 formed in the holding member 30, the guiding member is not limited to the terminal receiving portions 35 or the shape of the guiding member is not limited, according to the present invention, so long as the guiding member is connected to the terminal accommodation chamber 52. For example, the male terminal metal members 11 can also be guided into the terminal accommodation chambers 32 by having a simple cylindrical or rectangular opening formed in the holding member 30 so as to face the terminal accommodation chambers 52.

While preferred embodiments of the present invention have been described using specific terms, such description is for illustrative purposes, and it is to be understood that changes and variations may be made without departing from the spirit or scope of the following claim.

What is claimed:

1. A connector comprising:

a plurality of first subconnectors each having first and second terminal accommodation chambers for accommodating first and second female terminal members, each first terminal accommodating chamber being generally above each second terminal accommodating chamber;

one or more second subconnectors each accommodating at least first and second male terminal members which are connected with the first and second female terminal members; and a holding member for holding the plurality of first subconnectors, the holding member being in engagement with the one or more second subconnectors so that the plurality of first subconnectors are engaged with one or more of the second subconnectors;

wherein the holding member includes a cover wall at a side engaged with one or more of the second subconnectors, the cover wall being formed with a terminal receiving portion having through holes for allowing passage therethrough of the first and second male terminal members of one or more of the second subconnectors to be connected with the first and second female terminal members;

and wherein the first female terminal member is provided in the first terminal accommodating chamber in a first orientation defining a first entrance portion for the first male terminal member, and wherein the second female terminal member is provided in the second terminal accommodating chamber in a second orientation opposite to the first orientation defining a second entrance portion for the second male terminal member.

2. The connector according to claim 1, wherein the holding member has an insertion opening for receiving the plurality of first subconnectors to be inserted at a side opposite to the cover wall.

3. The connector according to claim 2, wherein the plurality of first subconnectors are formed with an entrance portion at a side of the cover wall, the entrance portion opens to the terminal receiving portion having the through-hole when the plurality of first subconnectors are held by the holding member.

4. The connector according to claim 3, wherein the terminal receiving portion is formed with terminal grounding surfaces slanted for guiding the first and second male terminal members into the through holes to be connected with the first and second female terminal members.

5. The connector according to claim 1, wherein the first female terminal member includes a first portion attached to the first terminal accommodating chamber and a second portion curved generally into an arc, a radius of the arc projecting in a first direction, and wherein the second female member includes a first portion attached to the second terminal accommodating chamber and a second portion curved generally into an arc, a radius of the arc projecting in a second direction opposite the first direction.

* * * * *